US007258560B2

(12) United States Patent
Scafidi et al.

(10) Patent No.: US 7,258,560 B2
(45) Date of Patent: Aug. 21, 2007

(54) SPRING-LOADED ASSEMBLY FOR A CONNECTOR

(75) Inventors: Christopher J. Scafidi, Round Rock, TX (US); Karl Hamand, Austin, TX (US); Theodore C. Stamos, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/828,617

(22) Filed: Apr. 21, 2004

(65) Prior Publication Data

US 2005/0239309 A1 Oct. 27, 2005

(51) Int. Cl.
*H01R 13/64* (2006.01)

(52) U.S. Cl. ..... 439/248

(58) Field of Classification Search ..... 439/246–249, 439/946, 700, 382, 384; 361/683, 868, 684, 361/685

See application file for complete search history.

(56) References Cited

U.S. PATENT DOCUMENTS

| | | | | |
|---|---|---|---|---|
| 5,268,675 A | | 12/1993 | Garthwaite et al. | 345/163 |
| 5,318,455 A | * | 6/1994 | Villiers et al. | 439/248 |
| 5,417,595 A | | 5/1995 | Cullen et al. | 439/700 |
| 5,652,695 A | | 7/1997 | Schmitt | 361/685 |
| 6,097,308 A | | 8/2000 | Albert et al. | 340/825.44 |
| 6,434,314 B1 | | 8/2002 | Gatica et al. | 385/136 |
| 6,487,939 B1 | | 12/2002 | Cowher et al. | 81/9.51 |
| 6,532,327 B1 | | 3/2003 | Gatica et al. | 385/37 |
| 6,592,387 B2 | | 7/2003 | Komenda et al. | 439/247 |
| 6,598,828 B2 | | 7/2003 | Fiebick et al. | 244/118.1 |
| 6,600,866 B2 | | 7/2003 | Gatica et al. | 385/135 |
| 6,647,431 B1 | | 11/2003 | Utas | 709/313 |
| 6,657,431 B2 | | 12/2003 | Xiao | 324/244 |
| 6,665,483 B2 | | 12/2003 | Gatica | 385/136 |
| 6,666,984 B2 | | 12/2003 | Gatica et al. | 216/91 |

OTHER PUBLICATIONS

APT Thechnologies, Inc. et al., "*Serial ATA: High Speed Serialized AT Attachment*", 120 pgs, Jan. 7, 2003.

* cited by examiner

*Primary Examiner*—Felix O. Figueroa
(74) *Attorney, Agent, or Firm*—Baker Botts L.L.P.

(57) ABSTRACT

A spring-loaded assembly for coupling a connector to a computer component includes an assembly housing operable to receive a portion of a screw used to couple the connector to a chassis of an information handling system. The assembly further includes a sliding block disposed in the assembly housing and operably engaged with the screw. The sliding block is operable to move the connector between a first position and a second position. The assembly further includes a spring placed between the sliding block and at least one wall of the assembly housing. The spring operably provides an axial force to bias the connector to a first position, whereby coupling the connector to the computer component causes the connector to move to a connected position intermediate the first and second position.

16 Claims, 5 Drawing Sheets

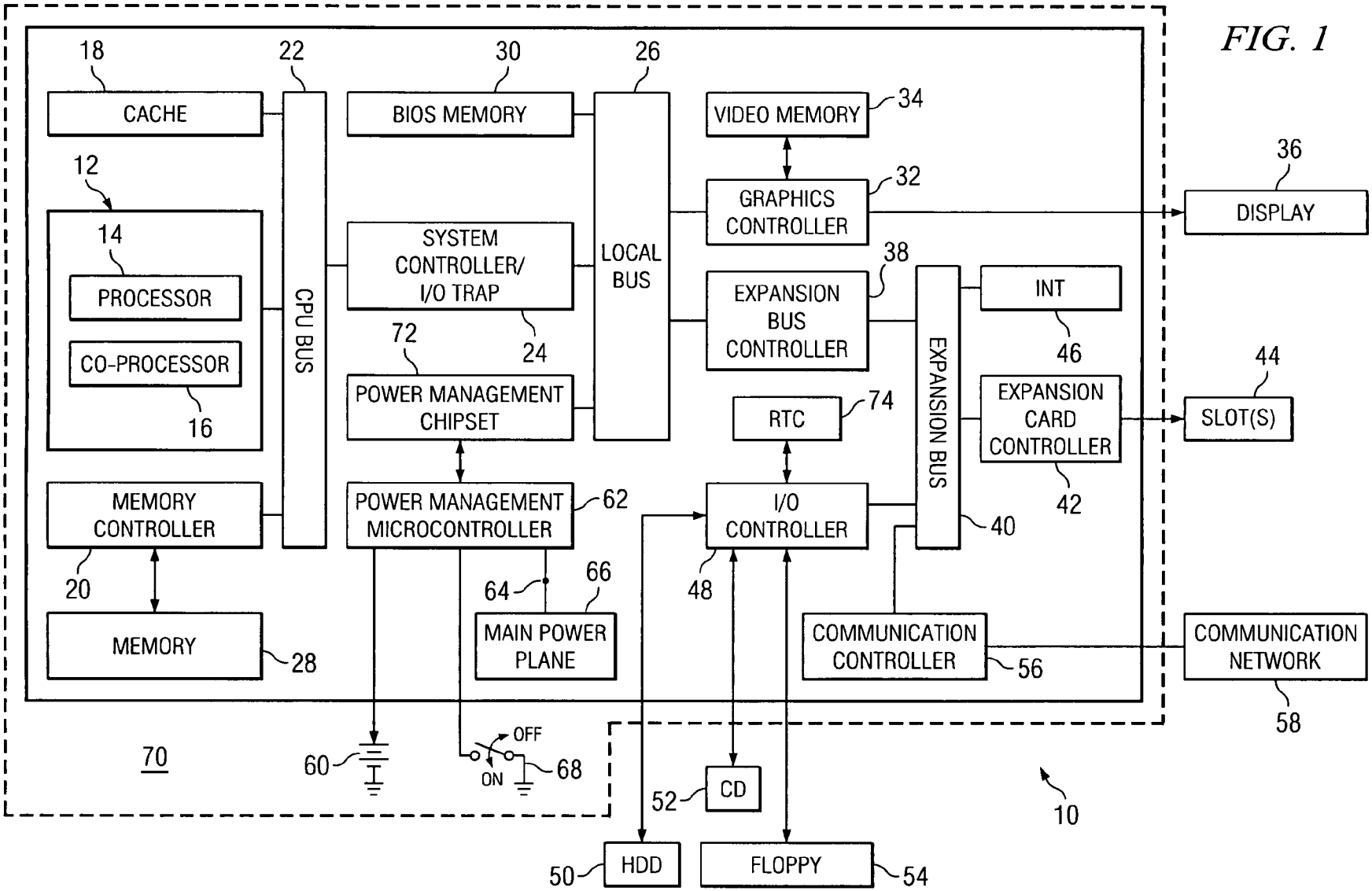
FIG. 1
DISPLAY
36
SLOT(S)
44
COMMUNICATION NETWORK
58
INT
46
EXPANSION CARD CONTROLLER
42
10
EXPANSION BUS
40
COMMUNICATION CONTROLLER
56
VIDEO MEMORY
34
GRAPHICS CONTROLLER
32
EXPANSION BUS CONTROLLER
38
RTC
74
I/O CONTROLLER
48
FLOPPY
54
CD
52
HDD
50
LOCAL BUS
26
BIOS MEMORY
30
SYSTEM CONTROLLER/ I/O TRAP
24
POWER MANAGEMENT CHIPSET
72
POWER MANAGEMENT MICROCONTROLLER
62
MAIN POWER PLANE
66
64
68
OFF
ON
60
CPU BUS
22
CACHE
18
PROCESSOR
14
CO-PROCESSOR
16
12
MEMORY CONTROLLER
20
MEMORY
28
70

SPRING-LOADED ASSEMBLY FOR A CONNECTOR

TECHNICAL FIELD

The present disclosure relates generally to information handling systems and, more particularly, to a spring-loaded assembly for a connector.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Due to consumer demand for smaller, denser and more powerful information handling systems, manufacturers strive to implement new methods to meet these demands. One such method includes the development of easier plug-in connections for computer components. Typically, plug-in connections aid in assembly of information handling systems because the connections use design information such as specification criteria to align mounting holes for each component. When a computer component is placed in a mounting location, the plug-in connection for the component is located based on specification data. Because the location of the connection is known, designers can set the connector to align with the plug-in connection such that automatic plug-in or blind plug-in of computer components is possible. In one example, the location of a plug-in connection for a hard disk drive (HDD) is determined from dimensions given in a HDD specification.

Typically, the dimensions for any specifications are given with a certain amount of manufacturing variances or tolerances (e.g., +/−0.5 millimeters). By adding each measurement including tolerances between the mounting locations and the plug-in connections on the device, a location of the plug-in connection, plus or minus all of the tolerances, can be determined. Generally, the tolerances are insignificant. However, given the demand for smaller and denser components, tolerances are becoming a significant factor in determining the location of the device.

For instance, a plug-in connector having two millimeters (mm) of contact or wipe for connecting to a mating connector may require at least one millimeter of wipe or contact area for an adequate connection. If the tolerance is determined to be 0.5 mm, an adequate connection is formed because at least 1.5 mm of contact remains. However, if the measurement between the mounting location and the plug-in connection is based on different measurements each having a tolerance, the sum of the tolerances determines the total tolerance for placing the computer component. For example, if the sum of the tolerances were +/−1.5 mm, based on the two-millimeter connection, the available contact area for the connection would be 0.5 millimeters and not enough to meet the design requirements of the one-millimeter of contact.

SUMMARY

Thus, a need has arisen for spring-loaded assembly.

In accordance with teachings of the present disclosure, in some embodiments, the present disclosure teaches a spring-loaded assembly for coupling a connector to a computer component includes an assembly housing operable to receive a portion of a screw used to couple the connector to a chassis of an information handling system. The assembly further includes a sliding block disposed in the assembly housing and operably engaged with the screw. The sliding block is operable to move the connector between a first position and a second position. The assembly further includes a spring placed between the sliding block and at least one wall of the assembly housing. The spring operably provides an axial force to bias the connector to a first position, whereby coupling the connector to the computer component causes the connector to move to a connected position intermediate the first and second position.

In other embodiments, an information handling system includes a processor and a memory communicatively coupled to the processor. The information handling system further includes a connector communicatively coupled to the processor. The connector operable to provide communications between the processor and a computer component. The connector having electrical contacts. The electrical contacts operable to couple to mated electrical contacts of the computer component. The information handling system further includes a spring-loaded assembly associated with the connector. The spring-loaded assembly operable to move the connector along an axial direction to couple with the computer component. The spring-loaded assembly includes an assembly housing operable to receive a portion of a screw used to couple the connector to a chassis of an information handling system. The spring-loaded assembly further includes a sliding block disposed in the assembly housing and operably engaged with the screw. The sliding block is operable to move the connector between a first position and a second position. The spring-loaded assembly further includes a spring placed between the sliding block and at least one wall of the assembly housing. The spring operably provides an axial force to bias the connector to a first position, whereby coupling the connector to the computer component causes the connector to move to a connected position intermediate the first and second position.

In further embodiments, a method of connecting a computer component to an information handling system includes attaching a connector to a portion of an information handling system. The connector associated with a spring-loaded assembly having a first position and a second position such that the connector is biased to a first position. The method further includes attaching the computer component to a mounting position with the information handling system such that the computer component forms a connection with the connector. The computer component is operable to be in electrical communications with the information handling system via the connector. The method further includes, based on the mounting position of the computer component, automatically moving the connector in an axial direction to a connected position that is intermediate the first and second position.

Important technical advantages of certain embodiments of the present invention include an axial compensation that allows for variances in manufacturing tolerances among computer components associated with information handling systems. Determining the placement of connectors for computer components based on specification data relies greatly on the ability to vary the position based on these tolerances. By providing movement in an axial direction via a spring deflection, the connection may be able to establish an acceptable connection. In one example, a tolerance of +/−2.5 millimeters is handled with a spring deflection of five millimeters.

Another important technical advantage of certain embodiments of the present invention includes cost savings due to automatic electrical connections. Because the connection may be a blind plug-in connection, manufacturers typically only have to install a computer component in the information handling system as the electrical connection is established automatically.

Yet another important technical advantage of certain embodiments of the present invention includes establishing a secured connection. Because the spring provides an axial force which directs the movement of the connector in an axial direction, the connection between the connector and a computer component may be maintained even though the information handling system encounters shocks or impacts (e.g., during shipping). Thus, resulting in fewer consumer calls regarding non-functioning components.

All, some, or none of these technical advantages may be present in various embodiments of the present invention. Other technical advantages will be apparent to one skilled in the art from the following figures, descriptions, and claims.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 1 is a block diagram showing an information handling system, according to teachings of the present disclosure;

DETAILED DESCRIPTION

Figure 2:
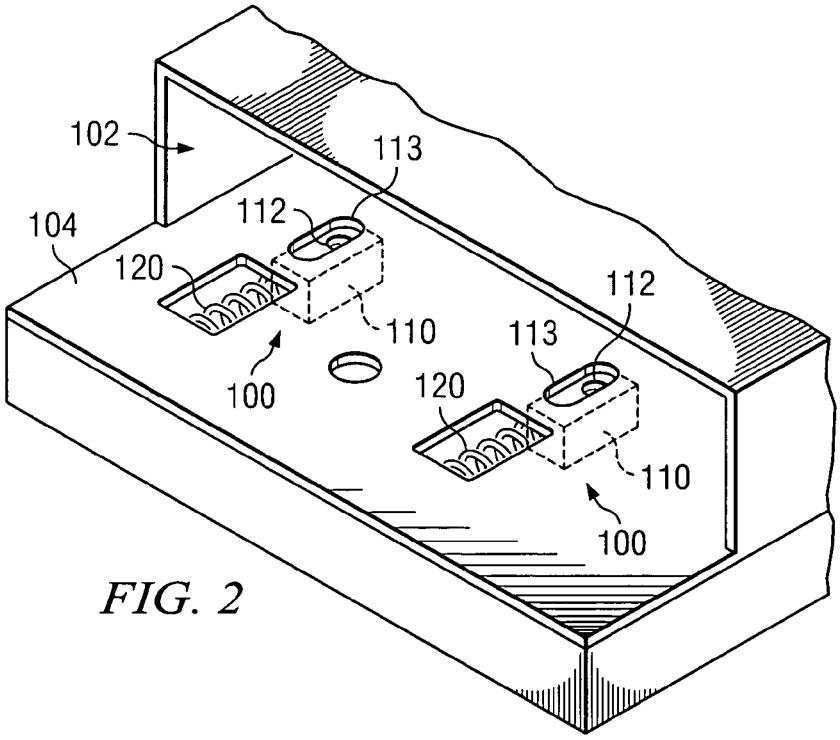
FIG. 2 illustrates a perspective view of a spring-loaded attachment point for a SATA connector in an information handling system, according to teachings of the present disclosure.

Preferred embodiments and their advantages are best understood by reference to FIGS. 1 through 9, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Referring first to FIG. 1, a block diagram of information handling system 10 is shown, according to teachings of the present disclosure. Information handling system 10 or computer system preferably includes at least one microprocessor or central processing unit (CPU) 12. CPU 12 may include processor 14 for handling integer operations and coprocessor 16 for handling floating point operations. CPU 12 is preferably coupled to cache 18 and memory controller 20 via CPU bus 22. System controller I/O trap 24 preferably couples CPU bus 22 to local bus 26 and may be generally characterized as part of a system controller.

Main memory 28 of dynamic random access memory (DRAM) modules is preferably coupled to CPU bus 22 by a memory controller 20. Main memory 28 may be divided into one or more areas such as system management mode (SMM) memory area (not expressly shown).

Basic input/output system (BIOS) memory 30 is also preferably coupled to local bus 26. FLASH memory or other nonvolatile memory may be used as BIOS memory 30. A BIOS program (not expressly shown) is typically stored in BIOS memory 30. The BIOS program preferably includes software which facilitates interaction with and between information handling system 10 devices such as a keyboard (not expressly shown), a mouse (not expressly shown), or one or more I/O devices. BIOS memory 30 may also store system code (note expressly shown) operable to control a plurality of basic information handling system 10 operations.

Graphics controller 32 is preferably coupled to local bus 26 and to video memory 34. Video memory 34 is preferably operable to store information to be displayed on one or more display panels 36. Display panel 36 may be an active matrix or passive matrix liquid crystal display (LCD), a cathode ray tube (CRT) display or other display technology. In selected applications, uses or instances, graphics controller 32 may also be coupled to an integrated display, such as in a portable information handling system implementation.

Bus interface controller or expansion bus controller 38 preferably couples local bus 26 to expansion bus 40. In one embodiment, expansion bus 40 may be configured as an Industry Standard Architecture ("ISA") bus. Other buses, for example, a Peripheral Component Interconnect ("PCI") bus, may also be used.

In certain information handling system embodiments, expansion card controller 42 may also be included and is preferably coupled to expansion bus 40 as shown. Expansion card controller 42 is preferably coupled to a plurality of information handling system expansion slots 44. Expansion slots 44 may be configured to receive one or more computer components 80 (shown below in more detail) such as an expansion card (e.g., modems, fax cards, communications cards, and other input/output (I/O) devices).

Interrupt request generator 46 is also preferably coupled to expansion bus 40. Interrupt request generator 46 is preferably operable to issue an interrupt service request over a predetermined interrupt request line in response to receipt of a request to issue interrupt instruction from CPU 12.

I/O controller 48, often referred to as a super I/O controller, is also preferably coupled to expansion bus 40. I/O controller 48 preferably interfaces to an integrated drive electronics (IDE) hard drive device (HDD) 50, CD-ROM (compact disk-read only memory) drive 52 and/or a floppy disk drive (FDD) 54. Other disk drive devices (not expressly shown) which may be interfaced to the I/O controller include a removable hard drive, a zip drive, a CD-RW (compact disk-read/write) drive, and a CD-DVD (compact disk—digital versatile disk) drive.

Communication controller 56 is preferably provided and enables information handling system 10 to communicate with communication network 58, e.g., an Ethernet network. Communication network 58 may include a local area network (LAN), wide area network (WAN), Internet, Intranet, wireless broadband or the like. Communication controller 56 may be employed to form a network interface for communicating with other information handling systems (not expressly shown) coupled to communication network 58.

As illustrated, information handling system 10 preferably includes power supply 60, which provides power to the many components and/or devices that form information handling system 10. Power supply 60 may be a rechargeable battery, such as a nickel metal hydride ("NiMH") or lithium ion battery, when information handling system 10 is embodied as a portable or notebook computer, an A/C (alternating current) power source, an uninterruptible power supply (UPS) or other power source.

Power supply 60 is preferably coupled to power management microcontroller 62. Power management microcontroller 62 preferably controls the distribution of power from power supply 60. More specifically, power management microcontroller 62 preferably includes power output 64 coupled to main power plane 66 which may supply power to CPU 12 as well as other information handling system components. Power management microcontroller 62 may also be coupled to a power plane (not expressly shown) operable to supply power to an integrated panel display (not expressly shown), as well as to additional power delivery planes preferably included in information handling system 10.

Power management microcontroller 62 preferably monitors a charge level of an attached battery or UPS to determine when and when not to charge the battery or UPS. Power management microcontroller 62 is preferably also coupled to main power switch 68, which the user may actuate to turn information handling system 10 on and off. While power management microcontroller 62 powers down one or more portions or components of information handling system 10, e.g., CPU 12, display 36, or HDD 50, etc., when not in use to conserve power, power management microcontroller 62 itself is preferably substantially always coupled to a source of power, preferably power supply 60.

Computer system, a type of information handling system 10, may also include power management chip set 72. Power management chip set 72 is preferably coupled to CPU 12 via local bus 26 so that power management chip set 72 may receive power management and control commands from CPU 12. Power management chip set 72 is preferably connected to a plurality of individual power planes operable to supply power to respective components of information handling system 10, e.g., HDD 50, FDD 54, etc. In this manner, power management chip set 72 preferably acts under the direction of CPU 12 to control the power supplied to the various power planes and components of a system.

Real-time clock (RTC) 74 may also be coupled to I/O controller 48 and power management chip set 72. Inclusion of RTC 74 permits timed events or alarms to be transmitted to power management chip set 72. Real-time clock 74 may be programmed to generate an alarm signal at a predetermined time as well as to perform other operations.

Information handling system 10 is typically associated with chassis 70. Generally, chassis 70 is referred to as the computer case or case that encloses the components of information handling system 10. However, some components such as CD 52, floppy 54 and HDD 50, may be detachable, replaceable, or even hot-swappable from information handling system 10. To ensure a reliable connection, information handling system 10 may include a spring-loaded connection or a spring-loaded connector such as a Serial Advanced Technology Attachment (SATA) connector. Although the present embodiment may describe a SATA connector, any connector may be used with the present disclosure.

FIG. 2 illustrates a perspective view of spring-loaded attachment point 100 for SATA connector 130 in information handling system 10. Spring-loaded attachment point 100 may form a portion of a mounting location for a computer component such as a hard disk drive. The hard disk drive may be received in enclosure 102 that may be connected to information handling system 10 or be located in a separate enclosure that is communicatively coupled to information handling system 10.

As described below in more detail, spring-loaded assembly 100 may be disposed along frame wall 104 of enclosure 102. In the present example, spring-loaded assemblies 100 are set to receive SATA connector 130 such that a mated connection of the hard disk drive aligns with the connector. However, spring-loaded assembly 100 may be used to couple to various types of connectors.

Figure 3A:
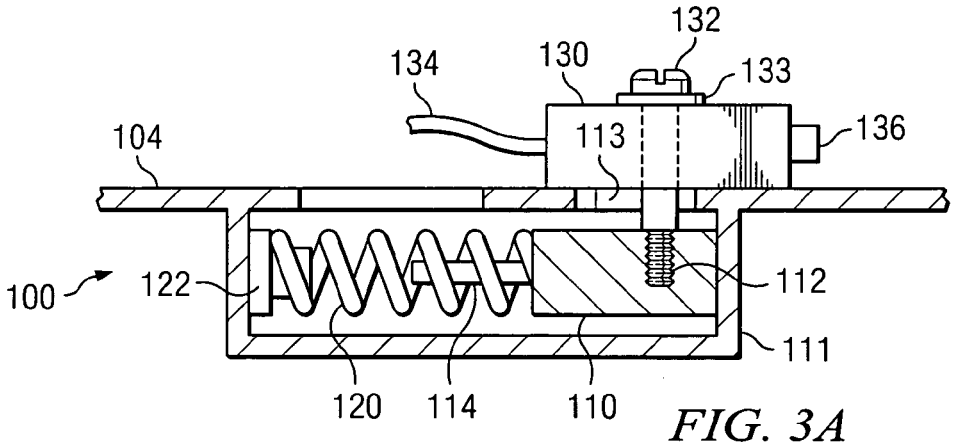
FIGS. 3A and 3B illustrate cross-sectional views of a portion of the spring-loaded attachment point with the SATA connector attached, according to an example embodiment of the present disclosure.
Figure 3B:
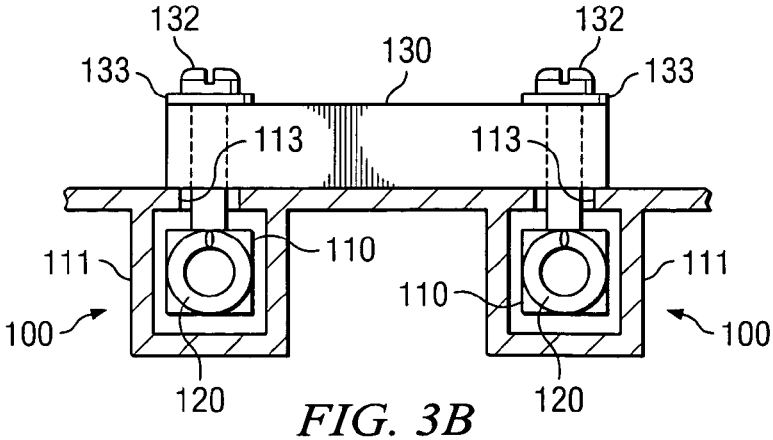

FIGS. 3A and 3B illustrate cross-sectional views of a portion of spring-loaded assembly 100 with SATA connector 130 attached. In the present embodiment, spring-loaded assembly 100 is formed adjacent to enclosure 102 such as on the opposite side of frame wall 104 in the air plenum of the chassis of information handling system 10.

Spring-loaded assembly 100 includes sliding nut 112 and spring 120. Sliding block or sliding nut 110 is typically formed with screw hole 112 such that screw hole 112 is designed to receive screw 132, such as a shoulder screw, including washer 133 from connector 130 via opening 113. In some embodiments, sliding nut 110 may include a standard nut that receives screw 132 such that spring 120 applies pressure against one side of the nut.

Spring 120 is formed and aligned to apply pressure or force against sliding nut 110 in an axial direction. To apply the axial force, spring 120 may be positioned between end stop 122 and sliding nut 110. As such, spring 120 may be coupled against one side of sliding nut 110. However, in other embodiments, spring 120 may be retained against sliding nut 110 with extension member 114. Because extension member 114 extends out from sliding nut 110, extension member 114 may be used to limit or restrict the travel of spring 120 under compression. In some embodiments, extension member 114 may be used to guide spring 120 or may be used to maintain spring 120 in the proper alignment.

Attachment point housing 111 may enclose the components of spring-loaded assembly 100. Housing 111 may further serve to guide the direction of spring-loaded assembly 100. For example, screw 132 including washer 133 may couple connector 130 to sliding nut 110 at screw hole 112 via opening 113. Because screw 132 passes through opening 113, opening 113 may be used to guide and/or restrict the movement of spring-loaded assembly 100.

As illustrated, connector 130 is coupled to spring-loaded assembly 100 via screw 132. Typically, connector 130 includes electrical wires 134 that extend into connector 130 for connection with electrical contacts 136. Electrical contacts 136 generally are formed to mate with opposing contacts from a computer component that is placed within enclosure 102. Because spring-loaded assembly 100 is formed as part of computer information system 10, spring-loaded assembly 100 may be able to receive several different types of common connectors. Thus, spring-loaded attachment point 100 may be interchangeable with several different connectors and computer components or devices.

Figure 4:
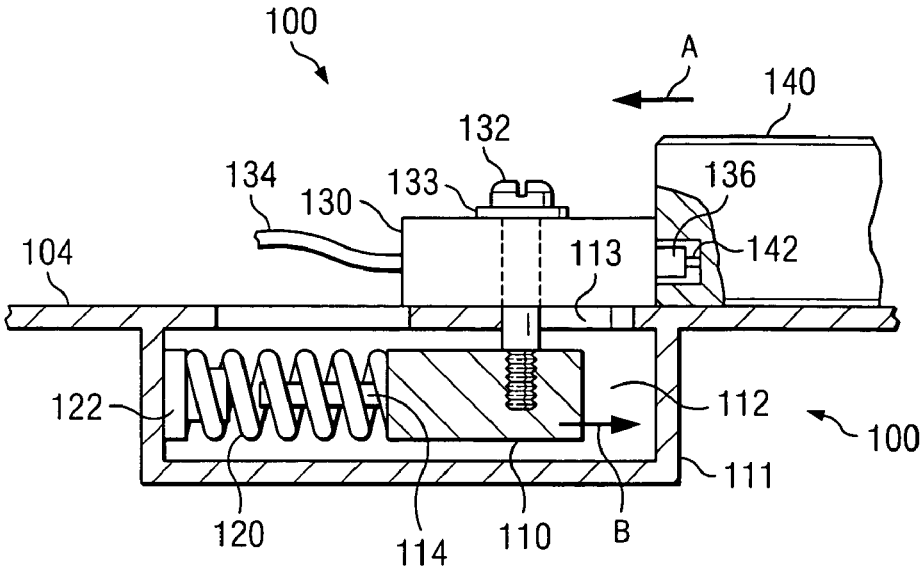
FIG. 4 illustrates a cross-sectional view of the SATA connector coupled to a hard drive using the spring-loaded attachment point, according to an example embodiment of the present disclosure.
Figure 5:
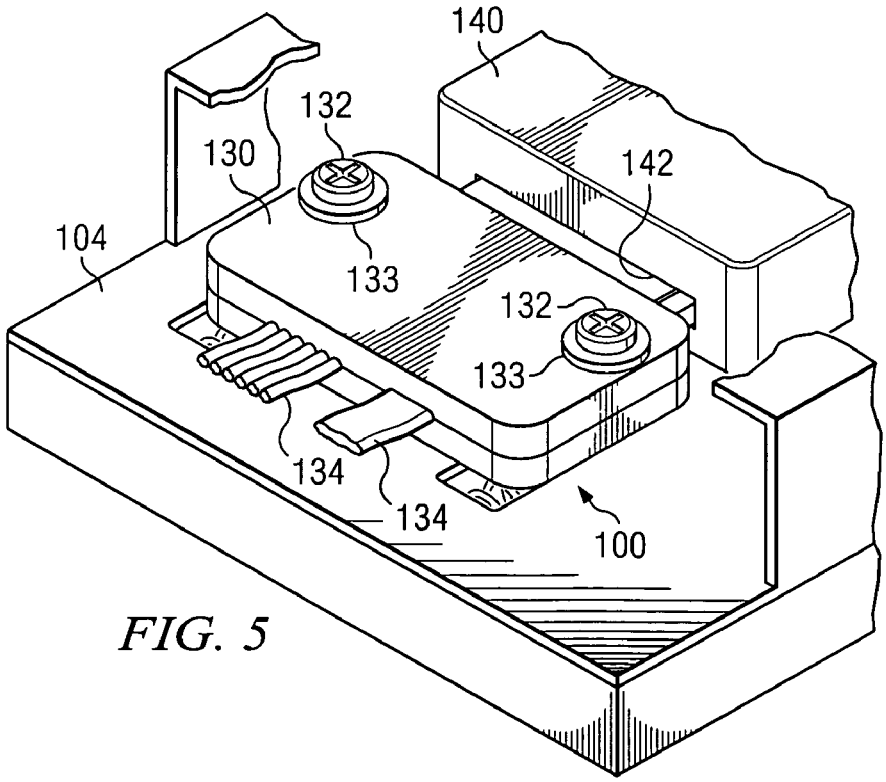
FIG. 5 illustrates a perspective view of the SATA connector coupled to the hard drive using the spring-loaded attachment point, according to an example embodiment of the present disclosure.

FIGS. 4 and 5 illustrate a cross-sectional and perspective view of SATA connector 130 coupled to hard drive 140 using spring-loaded assembly 100. With SATA connector 130 coupled to spring-loaded assembly 100, a computer component such as hard drive 140 may be placed into enclosure 102 of information handling system 10 such that mated electrical connectors 142 couple to electrical contacts 136 without the need for additional connections.

As hard drive 140 moves in the direction of arrow A, mated electrical connections 142 on hard drive 140 come into contact with electrical contacts 136. Hard drive 140 may continue to move in the direction of arrow A until fully seated inside of enclosure 102. Because connector 130 is coupled at spring-loaded assembly 100, connector 130 may slide in the direction of arrow A while maintaining electrical connection with hard drive 140 via electrical contacts 136 and mated electrical connections 142. Typically, the range of movement of spring 120 allows connector 130 to displace approximately five millimeters.

Because of the compressive force of spring 120, connector 130 may apply a spring force (e.g., an axial force) in the direction of arrow B. The spring force allows connector 130 to maintain a coupled or connected position with hard drive 140. Spring force may be varied based on connection conditions such as connection insertion force, vibration, impact or shock, possibly encountered during shipping.

As illustrated, connector 130 is displaced from a first position to a connected position as spring 120 generally bias connector 130 via sliding nut 110 to the first position. Generally, the connected position is an intermediate position between the first position and a second position. The second position is determined by the travel limit of spring 120 that results in the travel limit of connector 130. In certain embodiments, the travel limit of connector 130 is approximately five millimeters. Therefore, the second position is set at a distance of five millimeters from the first position.

The connected position may vary from component to component based on a component design specification. The component design specification may allow for manufacturing tolerances or design variances between components. Because of the varied positions, the travel limits of connector 130 may vary between the plus and minus conditions of the tolerances.

Typically, the first position of connector 130 is set according to one of the limits of a mounting tolerance for the computer component. For example, if the mounting location of the computer component was determined within +/−1.5 millimeters, then the first position would be at least 1.5 millimeters from the mounting position. Thus, in the present example, the overall travel limits of connector 130 would be designed to approximately three millimeters between the first position and the second position.

Figure 6:
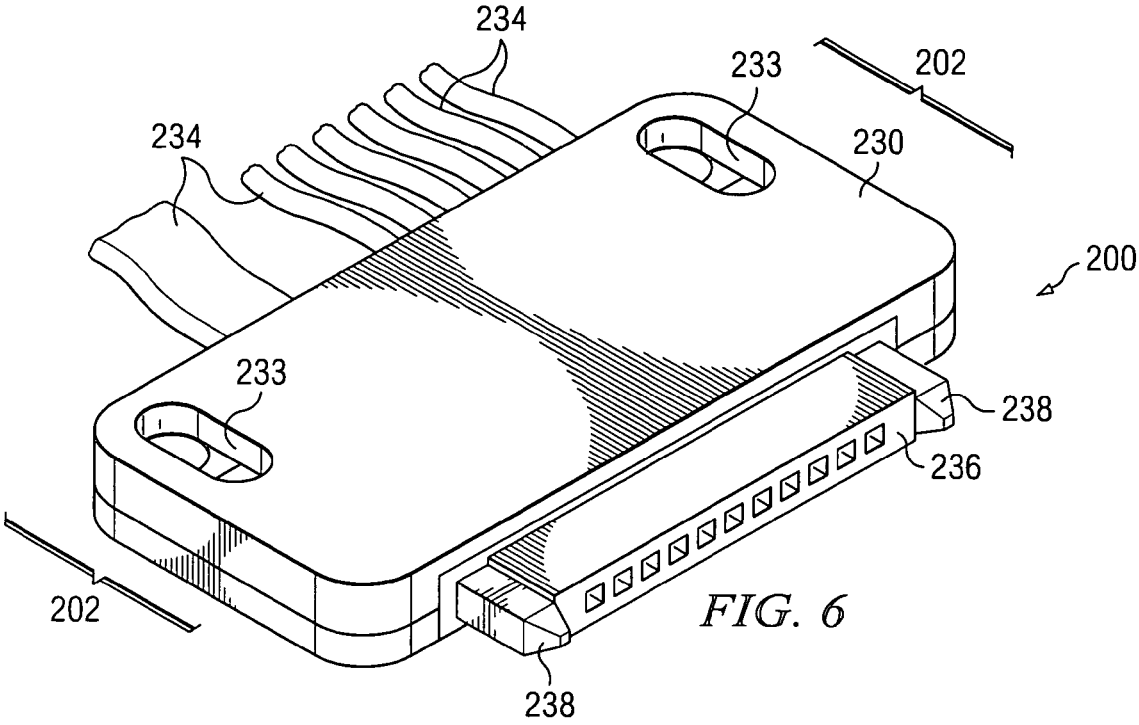
FIG. 6 illustrates a perspective view of a spring-loaded connector, according to an example embodiment of the present disclosure.
Figure 7:
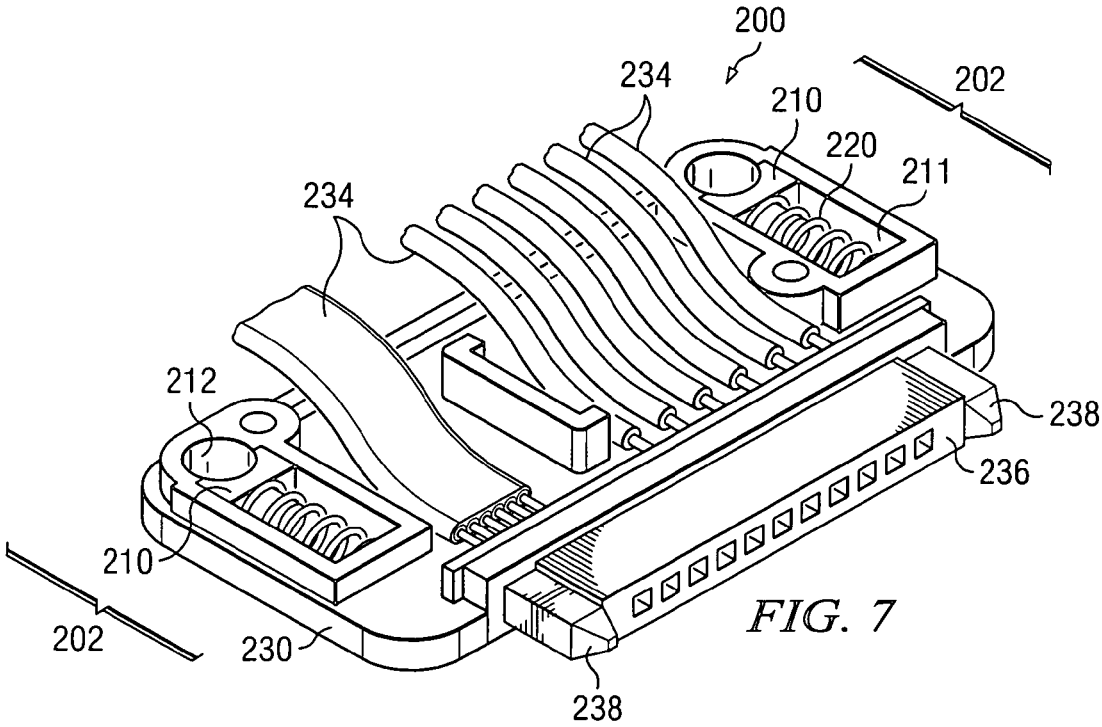
FIG. 7 illustrates a perspective view of the spring-loaded connector with a top portion of the housing removed, according to an example embodiment of the present disclosure.

FIGS. 6 and 7 illustrate a perspective view of spring-loaded connector 200 and a perspective view of spring-loaded connector 200 with a top portion of housing 230 removed. Typically, spring-loaded connector 200 includes spring-loaded assembly 202, housing 230, electrical wires, electrical contacts 236, and guide pins 230. Spring-loaded connector 200 may be constructed according to connector specifications such as connector specifications for SATA connectors. In certain embodiments, a SATA connector is modified to include spring-loaded assembly 202 to form spring-loaded connector 200.

Spring-loaded connector 200 may use one or more guide pins 238 to aid in aligning connector 200 with a computer component that is being placed within information handling system 10. By guiding the alignment of the connections, electrical contacts 236 correctly align with respective contacts on the computer component. Once connected, spring-loaded assembly 202 provides an axial force (e.g., spring force) to maintain the connection between electrical contacts 236 and the contacts on the computer component.

Spring-loaded connector 200 includes one or more spring-loaded assemblies 202. Each spring-loaded assembly 202 includes screw opening 212 and block 210. Screw opening 212 is operable to receive screw 232 (shown below in greater detail) and to couple connector 200 with a portion of information handling system 10.

Block 210 may form a portion of screw opening 212 such that a portion of block 210 rest against screw 232 for example a shoulder screw. As such, block 210 may include a curved portion to rest against screw 232. Typically, spring 220 is attached on the opposite end of block 210.

Spring 220 attached to assembly housing 211 generally opposite from block 210. The compression and decompression of spring 220 is retained within the travel restrictions of assembly housing 211.

Figure 8:
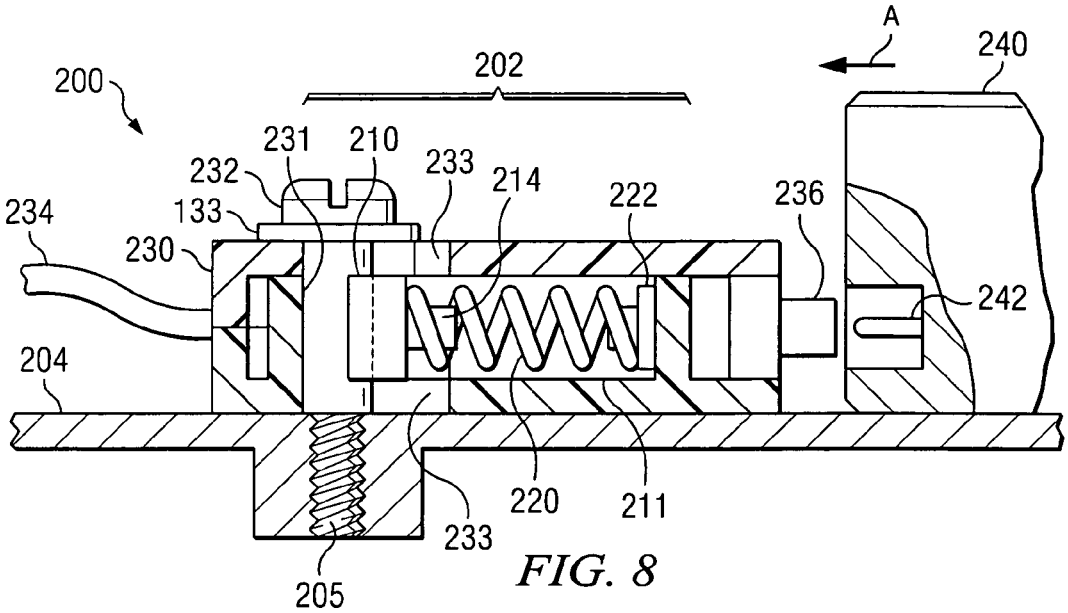
FIG. 8 illustrates a cross-sectional view of the spring-loaded connector mounted to a portion of an information handling system, according to an example embodiment of the present disclosure.

FIG. 8 illustrates a cross-sectional view of spring-loaded connector 200 mounted on frame 204. Spring-loaded connector 200 attaches to frame 204, which forms a part of information handling system 10. Using screw holes 205, screw 232 extends through connector 200 to retain connector against frame 204. Typically, screw 232 acts as a post to allow connector 200 to slide or move along frame 204 (e.g., a shoulder screw). Because the head of screw 232 is generally larger than slot 233, screw 232 retains connector 200 adjacent to frame 204. In some embodiments, screw 232 includes a washer (not expressly shown). Thus, connector 200 is prevented from moving parallel to screw 232 and limited to axial movements along the direction of spring 220.

Spring-loaded assembly 202 may further include end stop 222 and extension member 214. End stop 222 may be used to couple one end of spring 220 to the wall or side of assembly housing 211. In addition, end stop 222 may work in conjunction with extension member 214 to limit the travel of connector 200. Typically, extension member 214 is used to maintain the position of spring 220 within assembly housing 211 such that spring 220 is guided between compressed and extended positions. For example, during compression of spring 220, connector 200 is able to move or slide along an axial direction within assembly housing 211.

Connector 200 includes electrical contacts 236 that connect with wires 234. Electrical contacts 236 are operable to receive mated electrical contacts 242 from hard disk drive 240. In some embodiments, electrical contacts 236 are aligned with mated electrical contacts 242 via guide pins 238.

In an extended or first position, spring 220 applies a force against block 210 that pushes against screw 232 to displace connector 200 towards computer component such as hard disk drive 240. Generally, the limit of the first position is determined when screw 232 reaches back wall 231 of screw opening 212. As illustrated, mated electrical contacts 242 of hard disk drive 240 may be displaced towards connector 200 in the direction of arrow A in order to establish a connection between connector 200 and hard disk drive 240.

Figure 9:
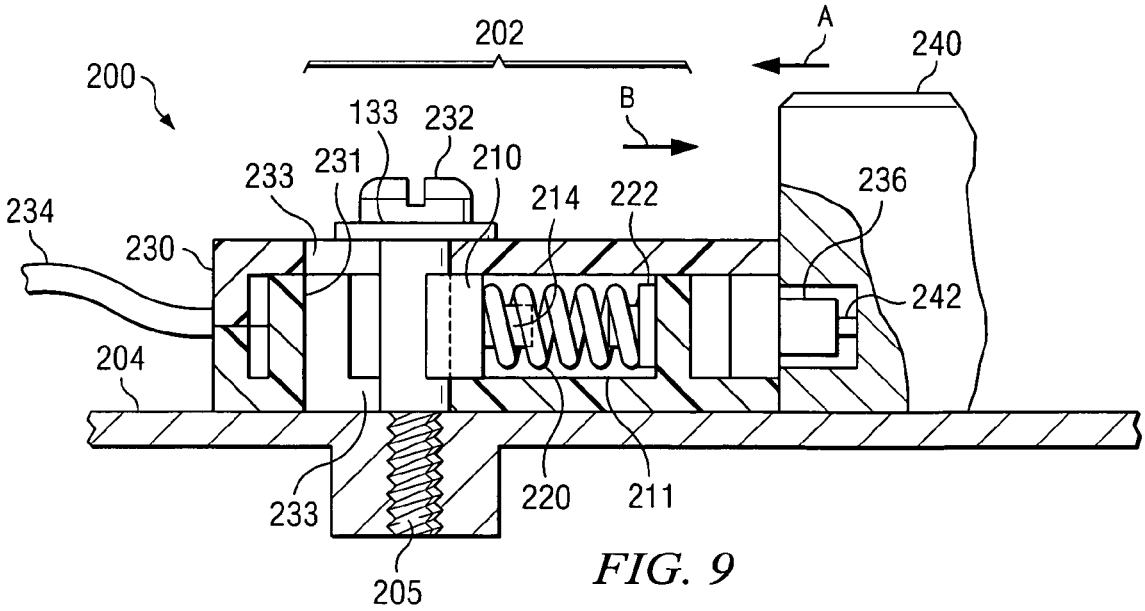
FIG. 9 illustrates a cross-sectional view of the spring-loaded connector coupled to a hard drive, according to teachings of the present disclosure.

FIG. 9 illustrates a cross-sectional view of spring-loaded connector 200 coupled to hard disk drive 240. Spring-loaded connector 200 in a connected position receives mated electrical contacts 242 of hard disk drive 240 at electrical contacts 236 on connector 200.

As illustrated, connector 200 is displaced from a first position to a connected position as spring 220 bias connector 200 to the first position. Generally, the connected position is an intermediate position between the first position and a second position. The second position is determined by the travel limit of spring 220 that results in the travel limit of connector 200. In certain embodiments, the travel limit of connector 200 is approximately five millimeters. Therefore, the second position is set at five millimeters from the first position.

The connected position may vary from component to component based on a component design specification. The component design specification may allow for manufacturing tolerances or design variances between components. Because of the varied positions, the travel limits of connector 200 may vary between the plus and minus conditions of the tolerances.

Typically, the first position of connector 200 is set according to one of the limits of a mounting tolerance for the computer component. For example, if the mounting location of the computer component was determined within +/−1.5 millimeters, then the first position would be at least 1.5 millimeters from the mounting position. Thus, in the present example, the overall travel limits of connector 200 would be designed to approximately three millimeters between the first position and the second position.

In addition to travel limits, connector 200 may further include a spring force that permits connector 200 to remain connected to hard disk drive 240. Spring force may be varied based on connection conditions such as connector insertion force, vibration, impact and/or shock.

Although the disclosed embodiments have been described in detail, it should be understood that various changes, substitutions and alterations can be made to the embodiments without departing from their spirit and scope.

What is claimed is:

1. A spring-loaded assembly for coupling a connector to a computer component comprising:

an assembly housing operable to receive a portion of a screw used to couple the connector to a chassis of an information handling system, a threaded portion of the screw extending along a first axis;

a sliding block housed by the assembly housing and operably engaged with the screw, the sliding block operable to linearly translate the connector between a first position and a second position along a second axis generally perpendicular to the first axis; and a spring placed between the sliding block and at least one wall of the assembly housing, the spring being compressible along the second axis to provide an axial force to bias the connector along the second axis towards the first position, whereby coupling the connector to the computer component causes the connector to move along the second axis to a connected position intermediate the first position and the second position.

2. The spring-loaded assembly of claim 1, further comprising an extension member coupled to and extending from the block, the extension member operable to guide the movement of the spring.

3. The spring-loaded assembly of claim 2, further comprising an end stop coupled to the assembly wall adjacent the spring, the end stop operable to interact with the extension member to fix the position of the second position.

4. The spring-loaded assembly of claim 1, wherein the assembly housing is formed on a portion of the chassis of an information handling system.

5. The spring-loaded assembly of claim 1, wherein the connector is a modified SATA connector.

6. The spring-loaded assembly of claim 1, wherein the axial force comprises a connector insertion force.

7. An information handling system comprising:

a processor;

a memory communicatively coupled to the processor;

a connector communicatively coupled to the processor, the connector operable to provide communications between the processor and a computer component;

the connector having electrical contacts, the electrical contacts operable to couple to mated electrical contacts of the computer component; and a spring-loaded assembly operable to facilitate connection of the connector and the computer component;

the spring-loaded assembly including:

an assembly housing operable to receive a portion of a screw used to couple the connector to a chassis of the information handling system, the screw extending along a first axis;

a sliding block disposed in the assembly housing and operably engaged with the screw, the sliding block operable to linearly translate the connector along a second axis generally perpendicular to the first axis, such that connection of the computer component and the connector causes the connector to translate along the second axis to a connected position between a first position and a second position of the connector; and a spring placed between the sliding block and at least one wall of the assembly housing, the spring being compressible along the second axis and operably providing an axial force to bias the connector along the second axis towards the first position.

8. The information handling system of claim 7, wherein the computer component is a hard disk drive.

9. The information handling system of claim 7, wherein the connector is a Serial Advanced Technology Attachment (SATA) connector.

10. The information handling system of claim 7, wherein the connected position varies based on variations in manufacturing tolerances of the computer component.

11. The information handling system of claim 7, wherein the spring-loaded assembly further comprises a guide pin operable to align the electrical contacts of the connector with the mated electrical contacts of the computer component.

12. A method of connecting a computer component to an information handling system, comprising:

attaching an assembly housing of a connector to a portion of an information handling system, the connector associated with a spring-loaded assembly having a first position and a second position such that the connector is biased toward the first position, the assembly housing operable to receive a portion of a screw connecting the connector thereto, the screw extending along a first axis, wherein the assembly housing houses a spring and a sliding block aligned along a second axis genera1ly perpendicular with the first axis;

attaching the computer component to a mounting position with the information handling system such that the computer component forms a connection with the connector, the computer component operable to be in electrical communication with the information handling system via the connector; and based on the mounting position of the computer component, the connector automatically moving along the second axis to a connected position between the first position and the second position, the movement of the connector moving the sliding block along the second axis and causing the spring to compress along the second axis.

13. The method of claim 12, wherein the connection is a blind plug-in connection.

14. The method of claim 12, further comprising the spring maintaining an axial force between the connector and the computer component along the second axis to prevent uncoupling due to shock or impact.

15. The method of claim 12, wherein attaching the computer component such that the computer component forms a connection with the connector comprises aligning a guide pin on the connector with the computer component.

16. The method of claim 12, wherein the distance between the first position and the second position is based on at least one manufacturing tolerance of the computer component.

* * * * *